US005422482A

United States Patent [19]

Nakajima et al.

[11] Patent Number: 5,422,482

[45] Date of Patent: Jun. 6, 1995

[54] MASS SPECTROMETRIC APPARATUS

[75] Inventors: Fumihiko Nakajima; Tadao Mimura, both of Katsuta, Japan

[73] Assignee: Hitachi, Ltd., Tokyo, Japan

[21] Appl. No.: 215,235

[22] Filed: Mar. 21, 1994

[30] Foreign Application Priority Data

Apr. 1, 1993 [JP] Japan ..... 5-075449

[51] Int. Cl.[6] ..... H01J 49/42

[52] U.S. Cl. ..... 250/292; 250/290

[58] Field of Search ..... 250/292, 290, 281, 282

[56] References Cited

U.S. PATENT DOCUMENTS

| | | | |
|---|---|---|---|
| 3,784,814 | 1/1974 | Sakai et al. | 250/292 |
| 5,177,359 | 1/1993 | Hiroki et al. | 250/292 |
| 5,227,629 | 7/1993 | Miseki | 250/292 |

OTHER PUBLICATIONS

"Quadrupole Mass Spectrometer, its Principle and Applications" (in Japanese), Kodansha Ltd., Publishers, 1984, pp. 4–11 (see Specification p. 1).

*Primary Examiner*—Jack I. Berman

*Attorney, Agent, or Firm*—Kenyon & Kenyon

[57] ABSTRACT

A mass spectrometric apparatus is disclosed which has quadrupole electrodes to which a DC voltage and a high-frequency voltage are applied in a superposed manner, and measures a mass spectrum by scanning particular mass numbers of ions passing through respective stable regions by changing the DC voltage and the high-frequency voltage in very small steps every predetermined time interval step while keeping a relationship in magnitude between the DC voltage and the high-frequency voltage in the stable regions which provide stable trajectories of the ions of the respective mass numbers. The mass spectrometric apparatus is further provided with control means for changing the relationship in magnitude between the DC voltage and the high-frequency voltage so that a part of the stable regions is changed to a divergent region in which ions of the particular mass numbers diverge and are prevented from passing through the quadrupole electrodes, the part of the stable regions corresponding to a particular mass number or mass range.

11 Claims, 4 Drawing Sheets ms
8
ION DETECTOR
4
U
V
-(U+V)
+(U+V)
3
13
12
WINDOW COMPARATOR
14
15
19
SAMPLE
ION SOURCE
1
18
S
9
LIQUID TRANSFERRING PUMP
17
16
MOVING PHASE LIQUID MASS LIMITING CONTROLLER
31
WINDOW COMPARATOR
12
13
14
15
S
9
ms
8
30
MEMORY
ION DETECTOR
4
U
V
-(U+V)
+(U+V)
3
ION SOURCE
1
SAMPLE
19
18
LIQUID TRANSFERRING PUMP
17
16
MOVING PHASE LIQUID

MASS SPECTROMETRIC APPARATUS

BACKGROUND OF THE INVENTION

The present invention relates to a mass spectrometric apparatus.

Generally, in a mass spectrometric apparatus, first a sample to be analyzed is ionized, and then a superposed electric field is so scanned that ions of the samples are passed in the order of their mass numbers. A mass spectrum is obtained by detecting the ions that are output in the order of their mass numbers. This type of technology is described on pages 4–11 of Fuwa and Fujii, "Quadrupole Mass Spectrometer, its Principle and Applications" (in Japanese), Kodansha Ltd., Publishers, 1984.

In a mass spectrometric apparatus, it may be the case that a large amount of ions reach the detector simultaneously. For example, in a liquid chromatograph mass spectrometric apparatus, ions corresponding to a moving phase simultaneously reach a detector when an electric field is so set as to allow passage of ions having a mass number corresponding to the moving phase. Also in a plasma ion mass spectrometric apparatus, ions of argon simultaneously reach a detector when an electric field is so set as to allow passage of, for instance, argon gas.

If a large amount of ions reach the detector simultaneously, the detector is saturated instantaneously and unable to detect subsequent small peaks. Further, if this saturation phenomenon occurs repeatedly, the detection sensitivity is deteriorated by an accumulation effect to hinder detection of a sample of a very small quantity.

SUMMARY OF THE INVENTION

An object of the present invention is to solve the above problems, that is, to provide a mass spectrometric apparatus which is free from the saturation phenomenon of a detector, and is therefore capable of detecting a sample of a very small quantity.

To attain the above object, a mass spectrometric apparatus is provided which comprises an ionizing section for producing ions of a sample; a scanning section for scanning mass numbers of the ions of the sample by changing an electric field applied to the ions to cause the ions to pass through the scanning section in the order of the mass numbers; an ion detector for detecting the ions passed through the scanning section; and a limiting section for limiting ions having a particular mass number so that they do not reach the ion detector.

The above constitution can prevent unnecessary ions from reaching the ion detector. As a result, the saturation phenomenon of the ion detector can be prevented and, therefore, its sensitivity deterioration can also be prevented. Further, it becomes possible to detect a sample of a very small quantity.

DESCRIPTION OF THE PREFERRED EMBODIMENTS

Figure 1:
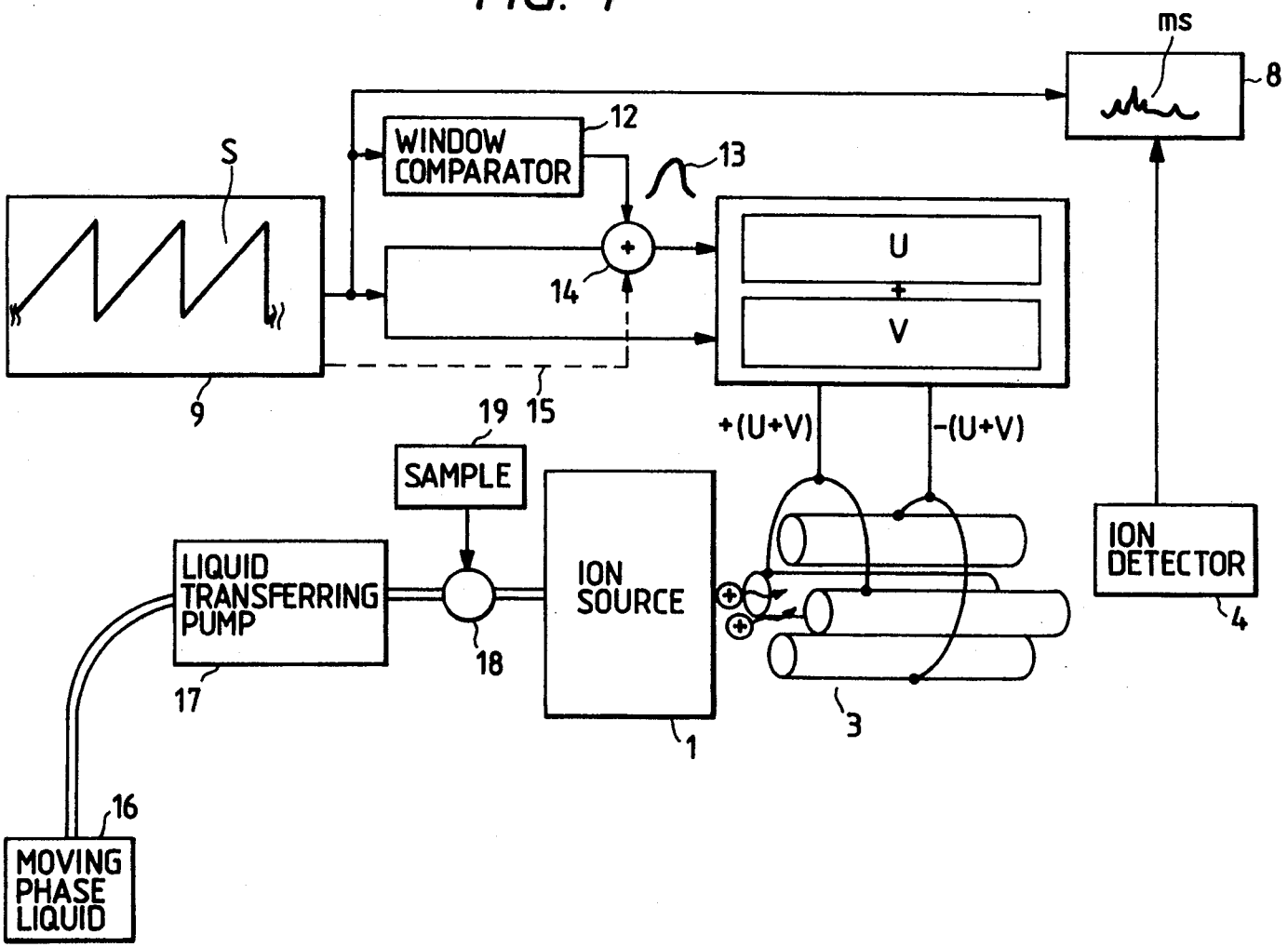
FIG. 1 schematically shows a liquid chromatograph mass spectrometric apparatus according to a first embodiment of the present invention.

Embodiments of the present invention will be hereinafter described with reference to the accompanying drawings.

A moving-phase liquid 16 is pressurized by a liquid transferring pump 17, and continuously supplied to a sample injection port 18. In this state, a sample 19 to be analyzed is instantaneously injected into the sample injection port 18. Thus, the moving-phase liquid 16 and the sample 19 are mixed in the inlet 18. The mixed liquid is introduced into an ion source 1 and ionized therein. Then, the ionized sample is introduced into a quadrupole electrodes 3.

A description will be made of the ion source 1. The ion source 1 may include a liquid chromatograph. In this case, the mixed liquid from the sample injection port 18 is introduced into the liquid chromatograph, where it is separated into respective components. The separated components are then ionized sequentially. The ion source 1 may be of a type based on the electrospray (ESI) method or the atmospheric pressure chemical ionization (APCI) method.

Further, the ion source 1 may be a plasma ion source. In this case, a gas such as argon gas is employed instead of the moving-phase liquid. That is, in the ion source 1, argon is rendered in a plasma state at a high temperature under a strong magnetic field. Then, influenced by the ion plasma, a sample is plasmatized, i.e., ionized.

Next, the quadrupole electrodes 3 will be described. The quadrupole electrodes 3 comprise four electrodes arranged in parallel with each other. Among those electrodes, two opposing electrodes are electrically connected to each other, and a DC voltage U and a high-frequency voltage V cos $\omega t$ (hereinafter referred as a "high-frequency voltage V") are applied between the other two electrodes in a superposed manner. Ions introduced along the axis of the four electrodes are caused to oscillate in accordance with their mass numbers by a high-frequency electric field developing perpendicularly to the axis of the electrodes.

Ions having a certain mass number takes a stable trajectory, and ions having another mass number takes an unstable trajectory. The former ions pass through the quadrupole electrodes 3 and reach an ion detector 4, where they are detected. The latter ions are absorbed by the quadrupole electrodes 3, that is, do not reach the ion detector 4. In this manner, a detectable mass number is determined by the voltages, which are varied as described above. All the ions having a certain detectable mass number reach the ion detector 4. Thus, a mass spectrum is obtained.

A measurement procedure of the above quadrupole mass spectrometer will be described in detail.

Figure 2:
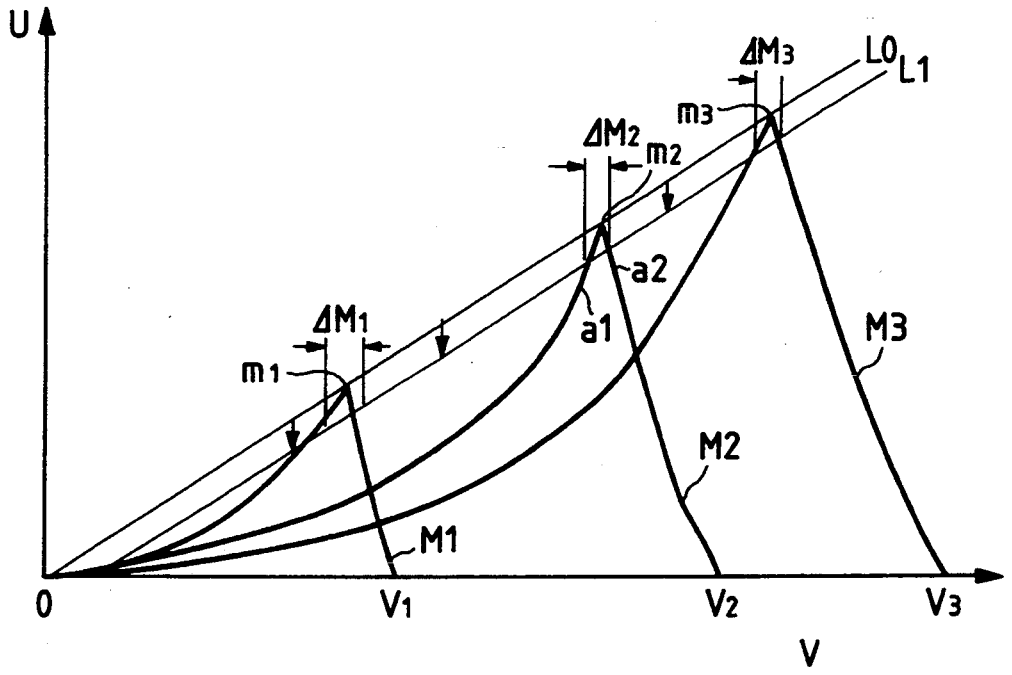
FIG. 2 is a stability diagram on an applied voltage (U, V) plane of a quadrupole mass spectrometer.

FIG. 2 is a stability diagram on an applied voltage (U, V) plane. In FIG. 2, the origin is denoted by O and the horizontal and vertical axes represent the high-frequency voltage V and the DC voltage U, respectively. With this representation, triangular regions $Om_1v_1$, $Om_2v_2$ and $Om_3v_3$ are what is called stable regions for ions having mass numbers $M_1$, $M_2$ and $M_3$ ($M_1<M_2<M_3$), respectively, which regions provide stable trajectories for those ions.

The scanning of the DC voltage U and the high-frequency voltage V is performed on a straight line OL1 obtained by slightly translating downward a straight line OL0 that connects the apices $m_1$, $m_2$ and $m_3$ of the above regions.

For example, in the case of the mass number stability is obtained on a line segment $\Delta M_2$ between an intersection $a_1$ of an arc $Om_2$ and the line OL1 and an intersection $a_2$ of an arc $m_2v_2$ and the line OL1.

A consideration will be of the resolution of this quadrupole mass spectrometer. If the mass number is $M_2$ and a half-value width of its mass peak is $\Delta M_2$, the resolution is expressed as $M_2/\Delta M_2$. That is, in the width of $\Delta M_2$ a mass spectrum peak of $M_2$ can be detected while being separated from adjacent peaks without superposition.

Therefore, the resolution is improved as OL1 approaches OL0 to make $\Delta M_2$ smaller.

On the other hand, if $\Delta M_2$ is kept constant, the resolution deteriorates as $M_2$ increases (larger mass number regions). The same thing applies to the cases of $M_1/\Delta M_1$ and $M_3/\Delta M_3$.

The above measurement method of making L1 closer to L0, which improves the resolution, means that ions to be introduced into the quadrupole electrodes 3 are limited. This reduces the sensitivity of the ion detector 4.

As described above, the measurement using the quadrupole electrodes has a feature that a mass spectrum is hardly obtained when components to be measured have large mass numbers and very small quantities and unnecessary components have small mass numbers and large quantities.

In general, the quadrupole electrodes 3 scan over the entire mass number range in several hundreds of milliseconds to several seconds. The ion detector 4 detects an ion current, and a mass spectrum display device 8 produces a mass spectrum ms for each scan.

Figure 3:
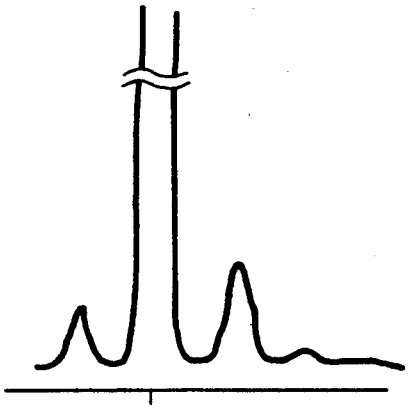
FIG. 3 shows a mass spectrum obtained when a window comparator does not operate.

A mass spectrum obtained without a sample is called a background spectrum, which is a measurement result of ions of the moving-phase liquid 16. FIG. 3 shows an example of such a measurement.

Immediately after injection of a sample, peaks of the sample 19 appear in a mass spectrum in addition to the peak of the moving-phase liquid 16.

If the sensitivity of the ion detector 4 is set high to measure the sample 19 of a very small quantity, both of ions of the sample 19 and ions originating from the moving-phase liquid 16, the latter passing during a mass scan, pass through the quadrupole electrodes 3 and such a large amount of ions reach the ion detector 4.

In general, the amount of the moving-phase liquid 16 may be $10^{10}$ to $10^{15}$ times larger than that of the sample 19 injected instantaneously.

Also in a high-frequency induction coupling plasma mass spectrometer, the amount of ions originating from an argon gas that always flows as a background is larger than that of an element to be measured.

When the background spectrum level is high as described above, the ion detector 4 saturates instantaneously.

The saturation of the ion detector 4 hinders detection of a very small peak of subject ions of a very small quantity. Further, the accumulation effect of repeated occurrences of the saturation accelerates deterioration of the sensitivity of the ion detector 4.

Referring to FIG. 1, the mass scanning signal outputting device 9 produces a mass scanning signal S, which serves to cause the quadrupole electrodes 3 to have such a scanning state as OL1 (see FIG. 2).

A mass number for separation is set in a window comparator 12. The window comparator 12 outputs a proper DC voltage and high-frequency voltage. These voltages are added to the mass scanning signal S by an adder 14, and then applied to the quadrupole electrodes 3.

A more detailed description will be made in the following.

The mass scanning signal (on which the outputs of the comparator 12 are superposed) serves to control a relationship in magnitude between the DC voltage U and the high-frequency voltage V. As described above in connection with FIG. 2, the resolution is determined by the slope of the mass scanning line, which passes through the vicinity of the origin.

In general, if the mass number and the half-value width of its peak are respectively denoted by M and $\Delta M$, the resolution is expressed as $$M/\Delta M=0.126/\{0.16784-(U/V)\} \quad (1)$$

If the values of U and V of the DC voltage U and the high-frequency voltage are set in Equation (1), based on the superposed signal from the window comparator 12, so as to satisfy a relationship $U=0.16784$ V, the resolution $M/\Delta M$ becomes infinity, which means what is called a divergent state. In this state, all the ions introduced into the quadrupole electrodes 3 are absorbed by the electrodes 3.

The value U of the DC voltage U need not be set strictly. But it is sufficient that the value U is so set that $U>0.1678$ V is satisfied to provide a relatively large resolution $M/\Delta M$, in which case a divergent state of a certain degree is attained.

Figure 4:
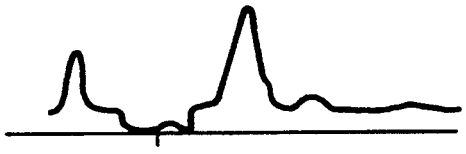
FIG. 4 shows a mass spectrum obtained in the first embodiment.
Figure 5:
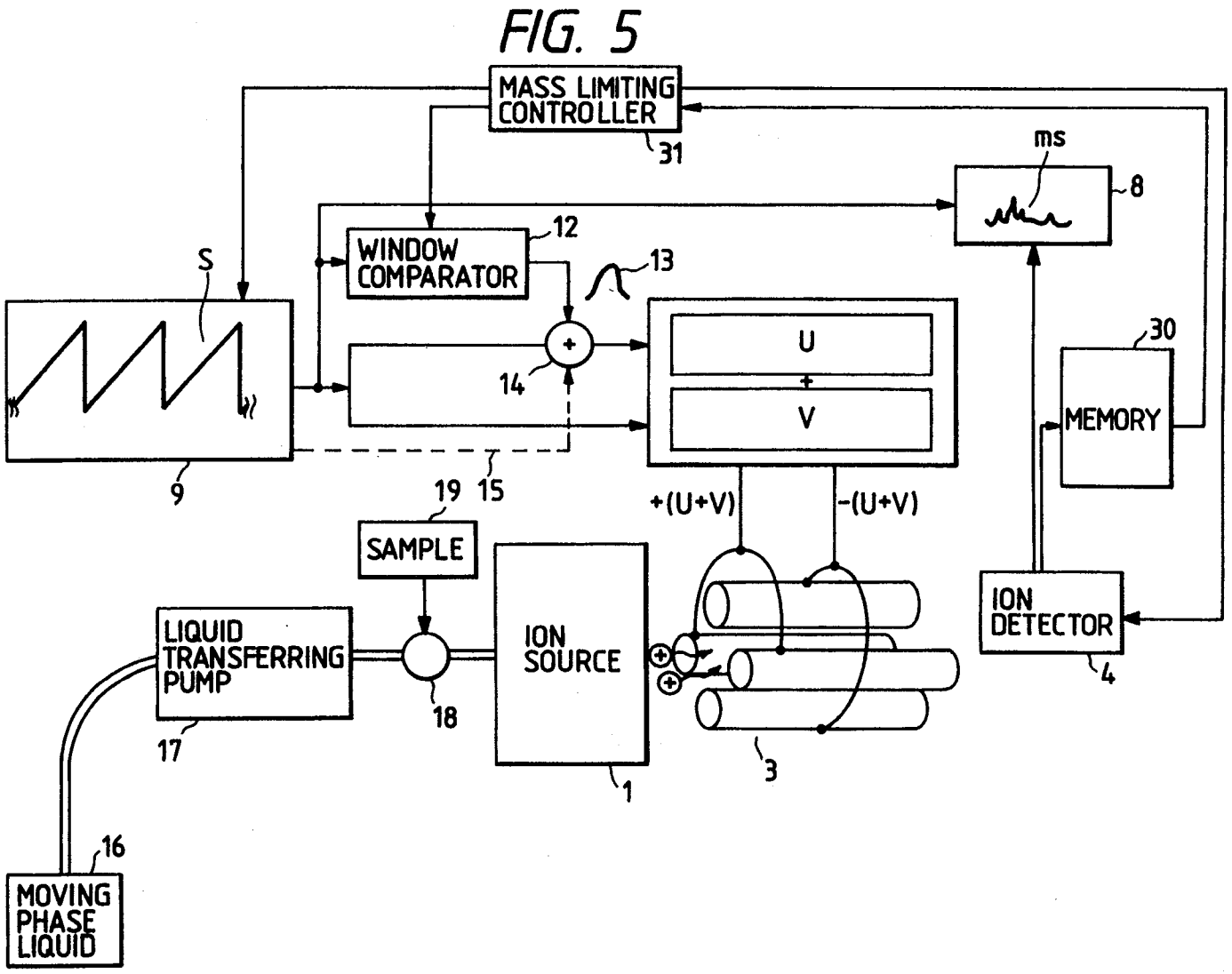
FIG. 5 schematically shows a liquid chromatograph mass spectrometric apparatus according to a second embodiment of the invention.

FIG. 4 shows an example of a mass spectrum obtained in the above manner.

It is preferred that in the window comparator 12 the removing mass number be set with a range of $\pm 0.5$. Further, the window comparator 12 may be so constructed that this range can be changed in accordance with the purpose of measurement.

A second embodiment of the invention will be described below. In the description of the second embodiment, only the parts different than the first embodiment will be explained, and the other parts are the same as those in the first embodiment.

In the second embodiment, the output of the ion detector 4 is stored in a memory 30. The output of the memory 30 is sent to a mass limiting controller 31. Based on the information sent from the memory 30, the mass limiting controller 31 performs calculations to produce a mass limiting range and a value to be added to the DC voltage U and the high-frequency voltage V.

First, the sensitivity of the ion detector 4 is lowered by means of an instruction produced by the mass limiting controller 31. Then, a preliminary scan is performed. That is, the adder 14 is bypassed to apply the mass scanning signal S directly to the quadrupole electrodes 3. An output of the ion detector 4 obtained by this preliminary scan is stored in the memory 30. Based on this information, the mass limiting controller 31 performs calculations and supply resulting values to the window comparator 12.

The window comparator 12 produces a signal 13 indicating the setting range, i.e., the removing mass number ±0.5, which is added to the mass scanning signal S by the adder 14 and serves to set the DC voltage at a higher value.

By generating, based on the signal 13, the DC voltage U so that the relationship U (the approximate value for the divergent region)>0.1678 V is satisfied, a mass spectrum is obtained in which a huge peak has been removed.

Figure 6:
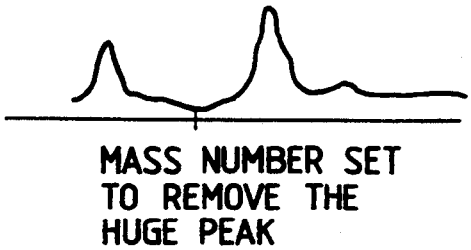
FIG. 6 shows a mass spectrum obtained in the second embodiment.

However, since the mass spectrum thus obtained is not an ordinary one in having steps, which steps may become a singular point in computer processing, the signal 18 is modified so as to have a smoother waveform. That is, after the DC voltage U is made sufficiently large so that U (the approximate value for the divergent region)>0.1678 V is satisfied and the resolution is set at a predetermined value, the setting is made so as to be closer to the diverging condition U=0.1678 V. FIG. 6 shows a mass spectrum obtained in this manner.

This mass spectrum is a natural one and, therefore, will not cause a singular point in computer processing. Thus, this mass spectrum can be used without difficulties.

Figure 7:
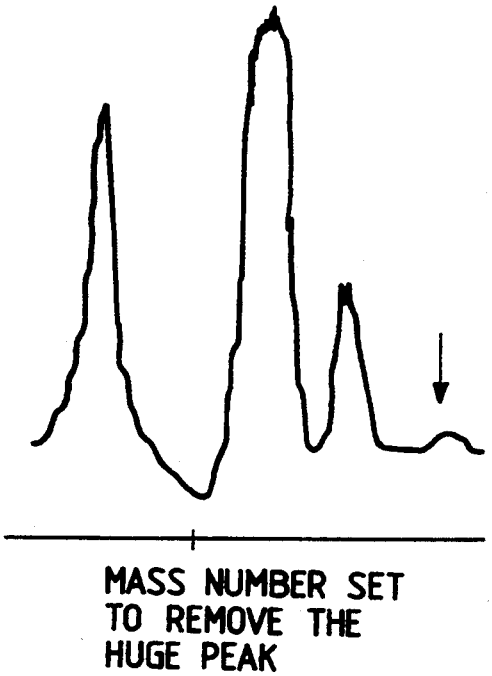
FIG. 7 shows a mass spectrum obtained by enlarging the mass spectrum according to the second embodiment.

FIG. 7 is a mass spectrum obtained by enlarging the mass spectrum of FIG. 6 by a factor of 5 in the vertical direction. A peak indicated by an arrow in FIG. 7 can be identified clearly.

At the fall of the mass scanning signal S, which is produced by the lass scanning signal outputting device 9, the DC current U decreases slightly earlier than the high-frequency signal V, so that the resolution may be reduced to cancel the divergent state. This will cause a large amount of ions other than subject ions to pass through the quadrupole electrodes S to reach the ion detector 4.

The relationship between the DC voltage U and the high-frequency voltage V can be kept so as to establish the divergent state by supplying a signal 15 directly to the adder 14 at the fall of the mass scanning signal S.

This prevents unnecessary ions from passing through the electrodes 3 until the next scan, to contribute to elongating the life of the detector 4.

As described above, a mass number or mass range of ions to be removed is determined by measuring what is called a background spectrum. The signal for increasing the setting voltage of the DC voltage U is sent to the voltage source during a portion of the mass scanning corresponding to that particular mass number or mass range. During that portion of the mass scanning, since the DC voltage U increases, the relationship in magnitude between the DC voltage U and the high-frequency voltage V, which are applied to the quadrupole electrodes, is controlled so as to establish the divergent state. Thus, ions to be removed are stopped from passing through the quadrupole electrodes.

In the case of changing the mass setting of ions to be measured, during the changing period when the DC voltage and the high-frequency voltage are in an unbalanced state, the DC voltage is increased to render the relationship in magnitude between the DC voltage U and the high-frequency voltage V, which are applied to the quadrupole electrodes, in the divergent region. Therefore, also in this period of changing the mass setting, the resolution of the spectrometer becomes infinity to prevent ions from passing through the quadrupole electrodes, Further, while a mass spectrum measurement of ions is not performed, the DC voltage U is increased to render the relationship in magnitude between the DC voltage U and the high-frequency voltage V, which are applied to the quadrupole electrodes, in the divergent region, so that the resolution of the spectrometer becomes infinity to prevent ions from passing through the quadrupole electrodes.

In summary, according to the invention, a large amount of ions of a particular mass number or mass range that is out of the mass range of a sample to be measured are prevented from passing through the quadrupole electrodes, i.e., reaching the ion detector by establishing the divergent state during a high-sensitivity detection period. As a result, the invention can provide the quadrupole mass spectrometer which facilitates the measurement of very small peaks and prevents deterioration of the ion detector.

More specifically, the advantages of the invention are as follows:

(1) The life of the detector is very much increased.

(2) A small peak adjacent to a high-intensity peak can be identified.

(3) Since the sensitivity of the detector can be set high, peaks which have not been detected conventionally can now be detected by the invention.

Also during a transition period of changing the mass setting in a step-like manner when the DC voltage U and the high-frequency voltage V are in an unbalanced state, the divergent state is established to prevent a large amount of ions from passing through the quadrupole electrodes. This also contributes to increasing the life of the detected, which is the same advantage as item (1) mentioned above.

The same advantage as item (1) can also be obtained by establishing the divergent state to prevent a large amount of ions from passing through the quadrupole electrodes while a mass spectrum measurement is not performed.

What is claimed is:

1. A mass spectrometric apparatus having quadrupole electrodes to which a DC voltage and a high-frequency voltage are applied in a superposed manner, and measuring a mass spectrum by scanning particular mass numbers of ions passing through respective stable regions by changing the DC voltage and the high-frequency voltage in very small steps every predetermined time interval step while keeping a relationship in magnitude between the DC voltage and the high-frequency voltage in the stable regions which provide stable trajectories of the ions of the respective mass numbers, said mass spectrometric apparatus comprising:

control means for changing the relationship in magnitude between the DC voltage and the high-frequency voltage so that a part of the stable regions is changed to a divergent region in which ions of the particular mass numbers diverge and are prevented from passing through the quadrupole electrodes, the part of the stable regions corresponding to a particular mass number or mass range.

2. The mass spectrometric apparatus according to claim 1, wherein said control means establishes the divergent region in a smooth manner.

3. A mass spectrometric apparatus having quadrupole electrodes to which a DC voltage and a high-frequency voltage are applied in a superposed manner, and measuring a mass spectrum by scanning particular mass numbers of ions passing through respective stable regions by changing a mass number of ions in a step-like to designate the particular mass numbers while keeping a relationship in magnitude between the DC voltage and the high-frequency voltage in the stable regions which provide stable trajectories of the ions of the respective mass numbers, said mass spectrometric apparatus comprising:

control means for changing, during the step-like change of the mass number, the relationship in magnitude between the DC voltage and the high-frequency voltage from the stable region to a divergent region in which ions of the particular mass numbers diverge and are prevented from passing through the quadrupole electrodes.

4. A mass spectrometric apparatus having quadrupole electrodes to which a DC voltage and a high-frequency voltage are applied in a superposed manner, and measuring a mass spectrum by scanning particular mass numbers of ions passing through respective stable regions by changing a mass number of ions in a step-like manner to designate the particular mass numbers while keeping a relationship in magnitude between the DC voltage and the high-frequency voltage in the stable regions which provide stable trajectories of the ions of the respective mass numbers, said mass spectrometric apparatus comprising:

control means changing, while a mass spectrum measurement is not performed, the relationship in magnitude between the DC voltage and the high-frequency voltage from the stable region to a divergent region in which ions of the respective mass numbers diverge and are prevented from passing through the quadrupole electrodes.

5. A mass spectrometric apparatus comprising:

an ionizing section for producing ions of a sample;

a scanning section for scanning mass numbers of the ions of the sample by changing an electric field applied to the ions to cause the ions to pass through the scanning section in the order of the mass numbers;

an ion detector for detecting the ions passed through the scanning section; and a limiting section for limiting ions having a particular mass number so that at least part thereof do not reach the ion detector.

6. A mass spectrometric apparatus according to claim 5, wherein said limiting section is so constructed as to limit ions corresponding to a material mixed into the sample.

7. A mass spectrometric apparatus according to claim 5, wherein said limiting section is so constructed as to limit ions corresponding to a moving-phase liquid of liquid chromatograph.

8. A mass spectrometric apparatus according to claim 5, wherein said limiting section is so constructed as to limit ions corresponding to a gas to be used for producing a plasma from the sample.

9. A mass spectrometric apparatus according to claim 8, wherein said gas is argon gas.

10. A mass spectrometric apparatus according to claim 5, wherein said scanning section performs its scanning operation preliminarily while a detection sensitivity of the ion detector is lowered, and said limiting section determines the particular mass number based on information obtained by the ion detector in the preliminary scanning operation.

11. A mass spectrometric apparatus according to claim 10, wherein said limiting means further determines a degree of limiting the ions having the particular mass number based on the information obtained by the ion detector in the preliminary scanning operation.

* * * * *

UNITED STATES PATENT AND TRADEMARK OFFICE

CERTIFICATE OF CORRECTION

PATENT NO. : 5,422,482

DATED : June 6, 1995

INVENTOR(S) : Fumihiko NAKAJIMA, et al.

It is certified that error appears in the above-indentified patent and that said Letters Patent is hereby corrected as shown below:

Column 2, line 22, delete "a".

Column 2, line 51, change "takes" to --take--.

Column 2, line 52, change "takes" to --take--.

Column 2, line 65, change "O" to --0--.

Column 3, line 10, after "number" insert --$M_2$,--.

Column 5, line 1, change "supply" to --supplies--.

Column 5, line 33, change "lass" to --mass--.

Column 6, line 35, change "detected" to --detector--.

Column 7, line 3, after "step-like" insert --manner--.

Signed and Sealed this

Tenth Day of October, 1995

Bruce Lehman

*Attest:*

BRUCE LEHMAN

*Attesting Officer*

*Commissioner of Patents and Trademarks*